US007497672B2

(12) United States Patent
Inagaki et al.

(10) Patent No.: US 7,497,672 B2
(45) Date of Patent: Mar. 3, 2009

(54) SCREW PUMP WITH INCREASED VOLUME OF FLUID TO BE TRANSFERRED

(75) Inventors: Masahiro Inagaki, Kariya (JP); Shinya Yamamoto, Kariya (JP); Makoto Yoshikawa, Kariya (JP); Yuya Izawa, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 0 days.

(21) Appl. No.: 11/891,531

(22) Filed: Aug. 9, 2007

(65) Prior Publication Data

US 2008/0038137 A1 Feb. 14, 2008

(30) Foreign Application Priority Data

Aug. 10, 2006 (JP) ..... P2006-217853

(51) Int. Cl.
*F03C 2/00* (2006.01)
*F03C 4/00* (2006.01)
*F04C 2/00* (2006.01)

(52) U.S. Cl. ..... 418/9; 418/75; 418/201.1

(58) Field of Classification Search ..... 418/9, 418/75, 201.1, 201.2, 206.1, 206.4
See application file for complete search history.

(56) References Cited

U.S. PATENT DOCUMENTS 3,108,740 A * 10/1963 Benedictus ..... 418/201.2
5,314,320 A * 5/1994 Shimizu et al. ..... 418/9
5,374,170 A * 12/1994 Shimizu et al. ..... 418/9
5,904,473 A * 5/1999 Dahmlos et al. ..... 418/206.1
6,359,411 B1 3/2002 Kösters et al.
6,447,276 B1 9/2002 Becher

FOREIGN PATENT DOCUMENTS

GB 648055 * 12/1950
JP 6-288369 10/1994
JP 2001055992 A * 2/2001

* cited by examiner

*Primary Examiner*—Theresa Trieu
(74) *Attorney, Agent, or Firm*—Morgan&Finnegan, LLP

(57) ABSTRACT

A screw pump includes a housing and a pair of intermeshing screw rotors. An end face of the rotor adjacent to an inlet port of the housing is provided with an inlet opening. Each rotor has a first portion whose lead angle changes. The first portions and the housing cooperate to form an inlet space. During rotation of the rotors, communication between the inlet space and the inlet port is blocked by the first portions and the housing thereby to form a closed pump space adjacent to the inlet space. Volume of the pump space is set smaller than the maximum volume of the inlet space. A closure member is provided which covers at least a part of the inlet openings. The closure member closes the inlet space when the volume of the inlet space exceeds that of the pump space.

10 Claims, 9 Drawing Sheets

SCREW PUMP WITH INCREASED VOLUME OF FLUID TO BE TRANSFERRED

BACKGROUND OF THE INVENTION

The present invention relates to a screw pump having a pair of intermeshing screw rotors.

As a conventional screw pump, a displacement machine for compressible medium is disclosed by Japanese Patent Application Publication No. 2001-55992. The displacement machine includes two shafts and two intermeshing rotors which are fixed on the two shafts, respectively. The shafts are rotatably supported by bearings in a pump casing of the displacement machine. As the rotors are rotated, medium is drawn into a pump room of the displacement machine through an inlet port of the displacement machine and is discharged out of the displacement machine from the pump room through an outlet port of the displacement machine. Each shaft is provided with its own electric motor, and the rotor on the shaft is driven by the electric motor. Two intermeshing gears are provided at the bottom on the shafts.

FIG. 9 shows the rotors which are designated by reference numeral 80. Each rotor 80 has an inlet opening 82, a changing lead portion 85, and constant lead portions 83, 84. The inlet opening 82 is formed in the end face of the rotor 80 adjacent to an inlet port. Lead angle of the changing lead portion 85 of the rotor 80 decreases from the end face thereof toward the constant lead portion 84. Lead angles of the constant lead portions 83, 84 are constant. The rotors 80 and a housing of the displacement machine (not shown) define an inlet space P and a plurality of closed pump spaces S. The inlet space P is in communication with the inlet port through the inlet opening 82, so that fluid is drawn into the inlet space P during the rotation of the rotors 80. The closed pump spaces S are formed adjacent to the inlet space P. The inlet space P changes its volume while the rotors 80 make a complete one turn, and the inlet space P is transferred to a pump space S when the rotors 80 have completed the one turn.

In this case, when the rotors 80 have completed the one turn, the fluid in the inlet space P is transferred to the pump space S. Thus, the volume of fluid of the closed pump space S is the fluid volume to be transferred in the screw pump. If the lead angle of the rotor 80 is constant, the fluid volume of the inlet space P remains substantially constant without a change during the rotation of the rotors 80. That is, the fluid volume of the pump space S after rotation of the rotors 80 substantially coincides with that of the inlet space P before rotation of the rotors 80.

In the above conventional art, however, the volume of fluid of the closed pump space substantially is the volume to be transferred. The inlet space which is formed by the first one turn of the lead and in communication with the inlet port does not provide fluid compression. Merely setting the volume of the inlet space larger than that of the pump space will not improve the efficiency of drawing in the fluid into the inlet space. In addition, the conventional art wherein the volume of the inlet space is not effectively used, the rotor need to be lengthened in order to improve the efficiency of drawing in the fluid into the inlet space.

The present invention is directed to a screw pump wherein the inlet space which is provided by the first one turn of the lead is utilized for fluid transferring thereby to increase the volume of fluid to be transferred in the screw pump.

SUMMARY OF THE INVENTION

In accordance with an aspect of the present invention, a screw pump includes a housing and a pair of screw rotors. The housing has an inlet port for allowing fluid to be drawn therethrough into the housing, and an outlet port for allowing the fluid to be delivered therethrough out of the housing. The screw rotors are rotatably disposed in the housing in engagement with each other. An end face of the rotor adjacent to the inlet port is provided with an inlet opening. Each rotor has a first portion whose lead angle changes. The first portions and the housing cooperate to form an inlet space which is in communication with the inlet port through the inlet openings for allowing the fluid to be drawn into the inlet space and whose volume is variable in accordance with the rotation of the rotors. During the rotation of the rotors, the communication between the inlet space and the inlet port is blocked by the first portions and the housing thereby to form a closed pump space adjacent to the inlet space. When the communication between the inlet space and the inlet port is blocked to form the closed pump space, a position of the rotors is defined as a starting position of one turn of the rotors. The inlet space changes its volume and its volume becomes the maximum in the range from the starting position to less than one turn of the rotors. Volume of the pump space is set smaller than the maximum volume of the inlet space by setting the lead angle of the first portions. A closure member is provided which covers at least a part of the inlet openings. The closure member closes the inlet space when the volume of the inlet space-exceeds that of the pump space.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
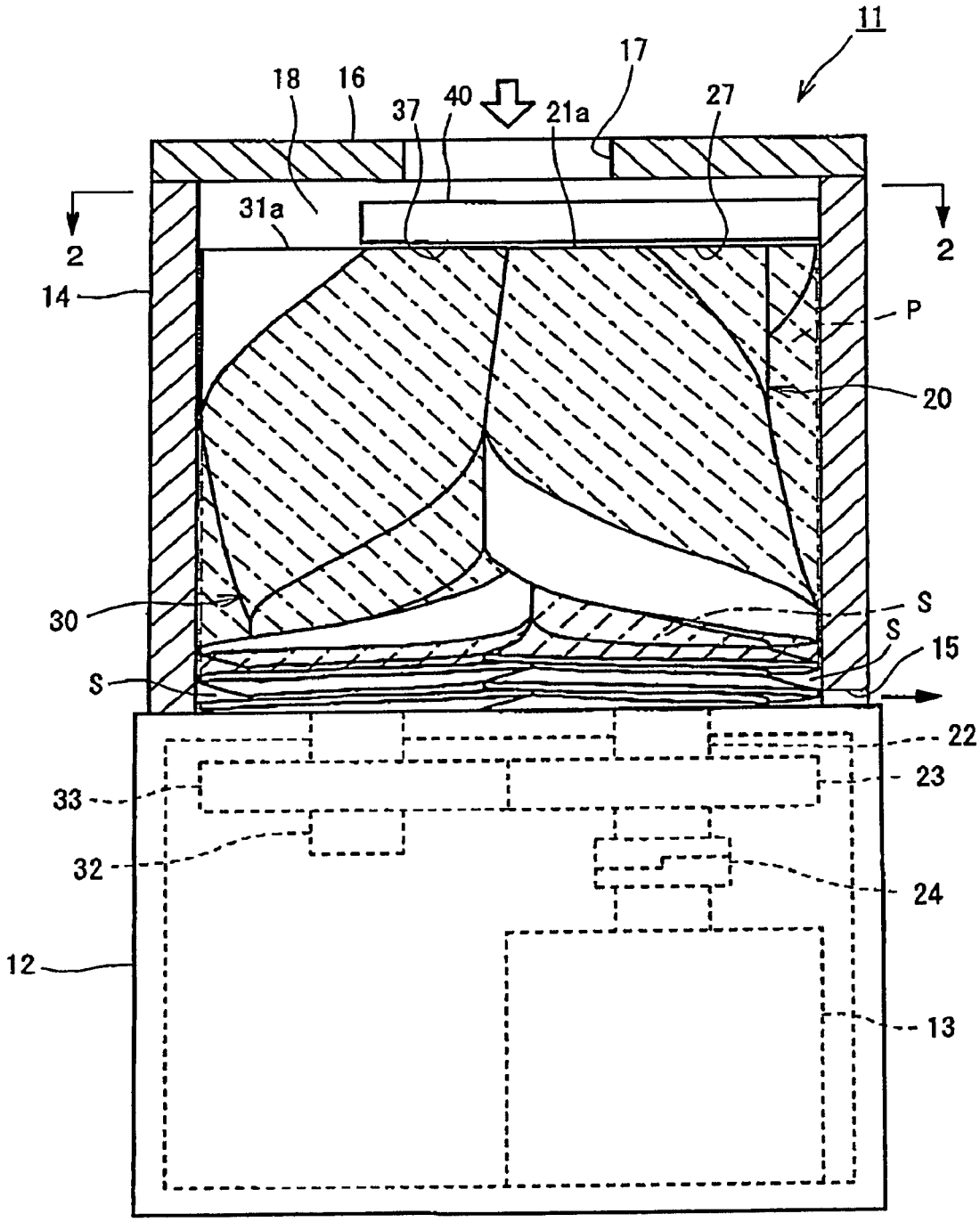
FIG. 1 is a longitudinal sectional view showing a screw pump according to a first embodiment of the present invention.
Figure 2:
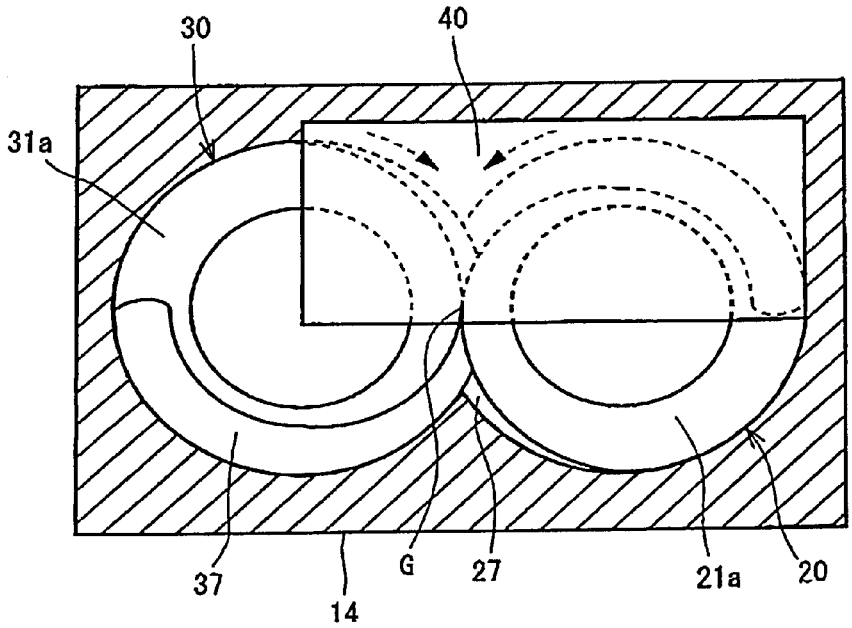
FIG. 2 is a cross sectional view taken along the line 2-2 of FIG. 1.

The following will describe a screw pump according to a first embodiment of the present invention with reference to FIGS. 1 to 6. FIG. 1 is a longitudinal sectional view showing a screw pump of the first embodiment, and FIG. 2 is a cross sectional view taken along the line 2-2 of FIG. 1. Referring to FIG. 1, the screw pump 11 is of a vertical type and used as a vacuum pump in the process of manufacturing semiconductors. The screw pump 11 includes a gear case 12, a rotor housing 14, an upper housing 16, a pair of intermeshing screw rotors 20, 30 and a cover plate 40. The rotor housing 14 has a cylindrical shape and is joined to the upper end of the gear case 12. The upper housing 16 has a flat shape and is joined to the upper end of the rotor housing 14. The rotors 20, 30 engaged with each other are provided in the rotor housing 14. The cover plate 40 has a rectangular shape and is fixed to the inner wall of the rotor housing 14. The cover plate 40 serves as a closure member.

The gear case 12 houses therein an electric motor 13 for driving the screw pump 11, a pair of intermeshing gears 23, 33 and a coupling 24. The gears 23, 33 allow the rotors 20, 30 to rotate in the opposite directions. The coupling 24 is operable to transmit torque of the electric motor 13 to the rotors 20, 30 or to cut off the torque of the electric motor 13. The rotor housing 14 forms a space whose shape corresponds to the shape of the intermeshing rotors 20, 30. As shown in FIG. 2, the horizontal section of the space is provided roughly by a figure "8". An outlet port 15 is formed in the rotor housing 14 at a position adjacent to the gear case 12, through which the space in the rotor housing 14 communicates with an external fluid circuit (not shown), so that the fluid in the screw pump 11 is delivered to the external fluid circuit through the outlet port 15. The rotor housing 14 and the gear case 12 are joined to each other by a fixing member such as a bolt (not shown).

The upper housing 16 closes the upper end of the rotor housing 14. An inlet port 17 is formed through the center of the upper housing 16. Through the inlet port 17 the space for the rotors 20, 30 and the external fluid circuit are in communication with each other, so that the fluid in the external fluid circuit is drawn into the screw pump 11 through the inlet port 17.

The rotors 20, 30 will now be described. In the present embodiment, the rotor 20 is the drive rotor while the rotor 30 is the driven rotor. The drive rotor 20, the driven rotor 30 and the rotor housing 14 cooperate to form a plurality of working chambers, or pump spaces, through which the fluid is transferred from the inlet port 17 to the outlet port 15 while being compressed.

The drive rotor 20 will now be described more in detail. The drive rotor 20 is driven to be rotated by the electric motor 13. The drive rotor 20 is mounted on a drive shaft 22 which extends out into the gear case 12. The gear 23 as a drive gear is mounted on the drive shaft 22 for rotation therewith in the gear case 12. The drive shaft 22 is rotatably supported by the gear case 12 through a bearing (not shown) and connected at the bottom end thereof to the coupling 24, which is in turn connected to the electric motor 13. The drive gear 23 engages with the gear 33 as a driven gear which is provided on the driven rotor 30 for transmitting torque of the drive rotor 20 to the driven rotor 30.

Figure 3:
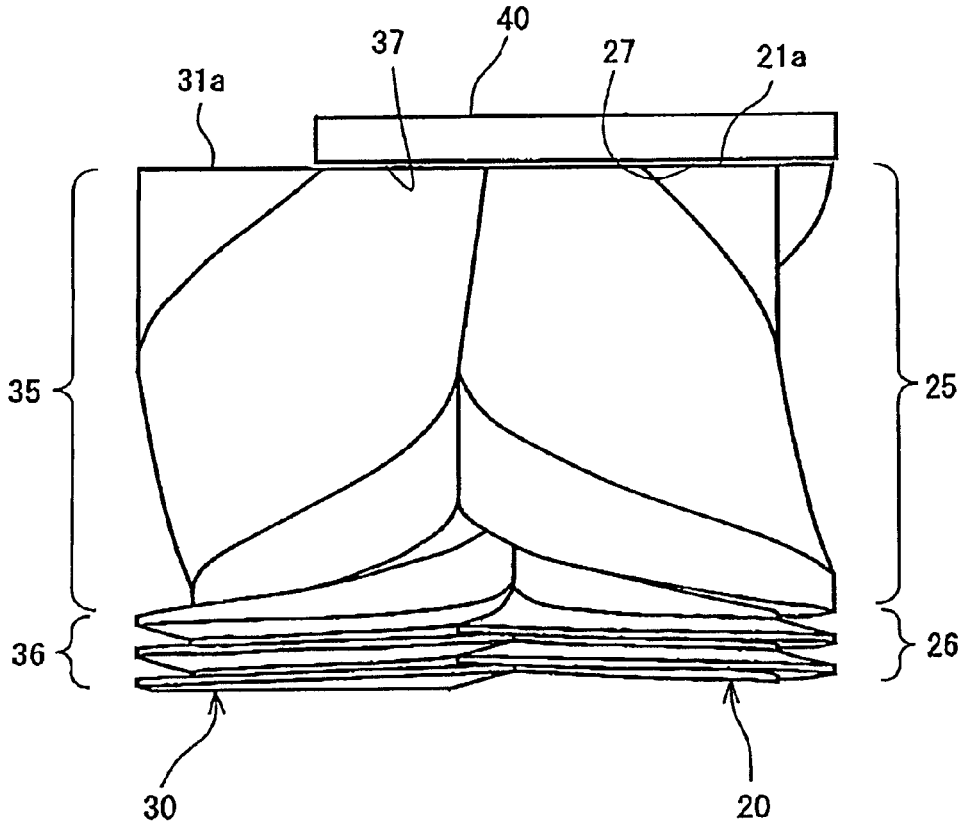
FIG. 3 is a front view showing a pair of intermeshing rotors of the screw pump.

The drive rotor 20 is of a single-start thread having a helical thread and a thread groove. As shown in FIG. 3, the drive rotor 20 has a first portion 25 and a second portion 26. The first portion 25 is formed extending from the end of the drive rotor 20 adjacent to the inlet port 17 to the vicinity of the outlet port 15. The second portion 26 is formed extending continuously from the first portion 25 to the end of the drive rotor 20 facing the gear case 12. As shown in FIG. 3, a lead angle of the first portion 25 (i.e. an angle made between a plane that is perpendicular to the axes of rotation of the rotors 20, 30 and the helix of the thread of the rotor 20) decreases progressively from the end on the drive rotor 20 adjacent to the inlet port 17 toward the outlet port 15, while the second portion 26 has a constant lead angle. Therefore, the lead angle of the first portion 25 of the drive rotor 20 is the maximum at the end of the drive rotor 20 adjacent to the inlet port 17.

On the other hand, the lead angle of the second portion 26 of the drive rotor 20 is constant and set smaller than the minimum lead angle of the first portion 25. The end face of the drive rotor 20 adjacent to the inlet port 17, which is designated by reference character 21*a*, is perpendicular to the rotary axis of the drive rotor 20. As shown in FIG. 2, the end face 21*a* is formed with an inlet opening 27 at which the thread groove starts.

The driven rotor 30 will now be described. The driven rotor 30 is rotated with the drive rotor 20. The driven rotor 30 is mounted on a driven shaft 32. Like the drive rotor 20, the driven rotor 30 is of a single-start thread having a helical thread and a thread groove. As shown in FIG. 3, the driven rotor 30 has a first portion 35 and a second portion 36. As shown in FIG. 2, an end face 31*a* of the driven rotor 30 adjacent to the inlet port 17 is provided with an inlet opening 37. As indicated earlier herein, the rotors 20, 30 intermesh with each other. As shown in FIG. 1, the rotors 20, 30, or the first portions 25, 35 and the rotor housing 14 cooperate to form an inlet space P at the end of the first portions 25, 35 of the rotors 20, 30 adjacent to the inlet port 17. The inlet space P is in communication with the inlet openings 27, 37 and the volume of the inlet space P is variable in accordance with the rotation of the rotors 20, 30. The inlet space P is also in communication with the inlet port 17 through the inlet openings 27, 37. During the rotation of the rotors 20, 30, the communication between the inlet space P and the inlet port 17 is blocked by the rotor housing 14 and the rotors 20, 30 thereby to define a plurality of closed pump spaces S adjacent to the inlet space P.

Figure 4:
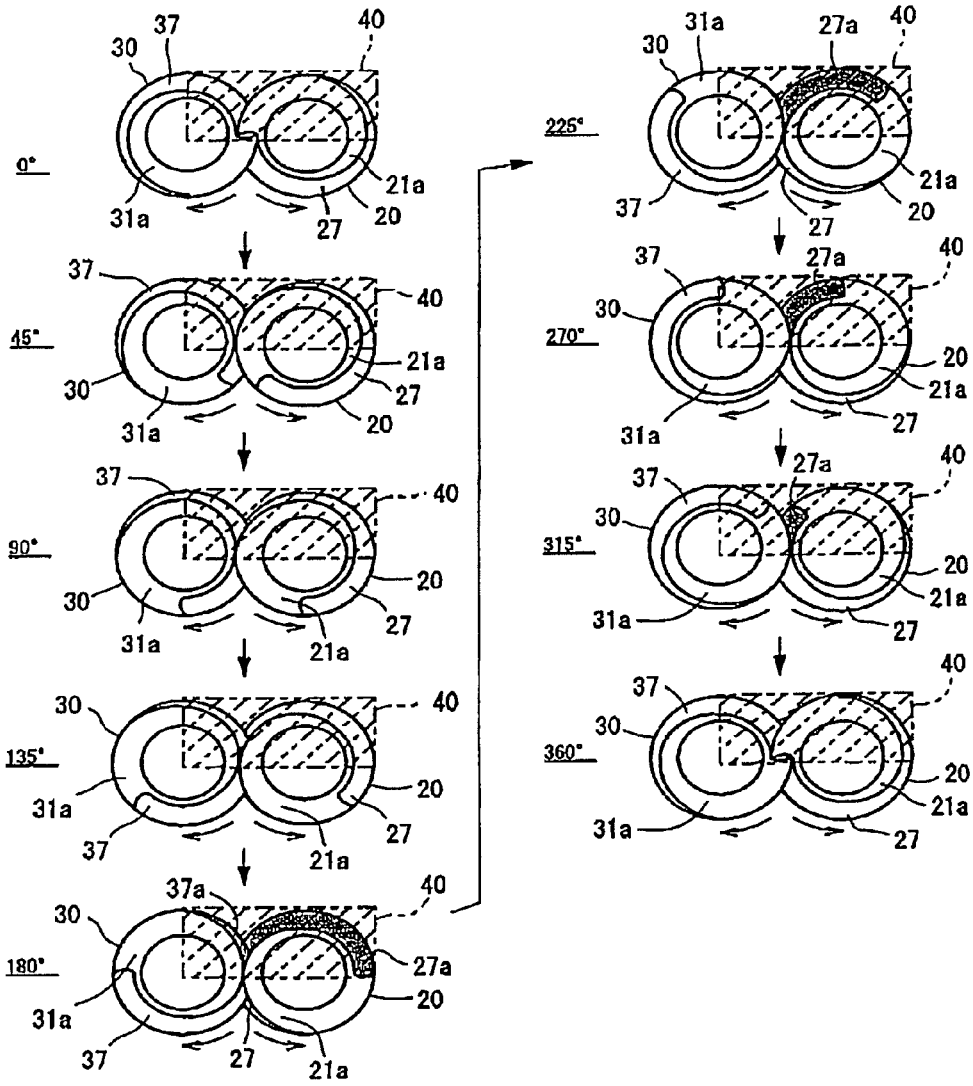
FIG. 4 is a schematic plan view showing the movement of end faces of the rotors adjacent to an inlet port during one turn of the rotors.
Figure 5:
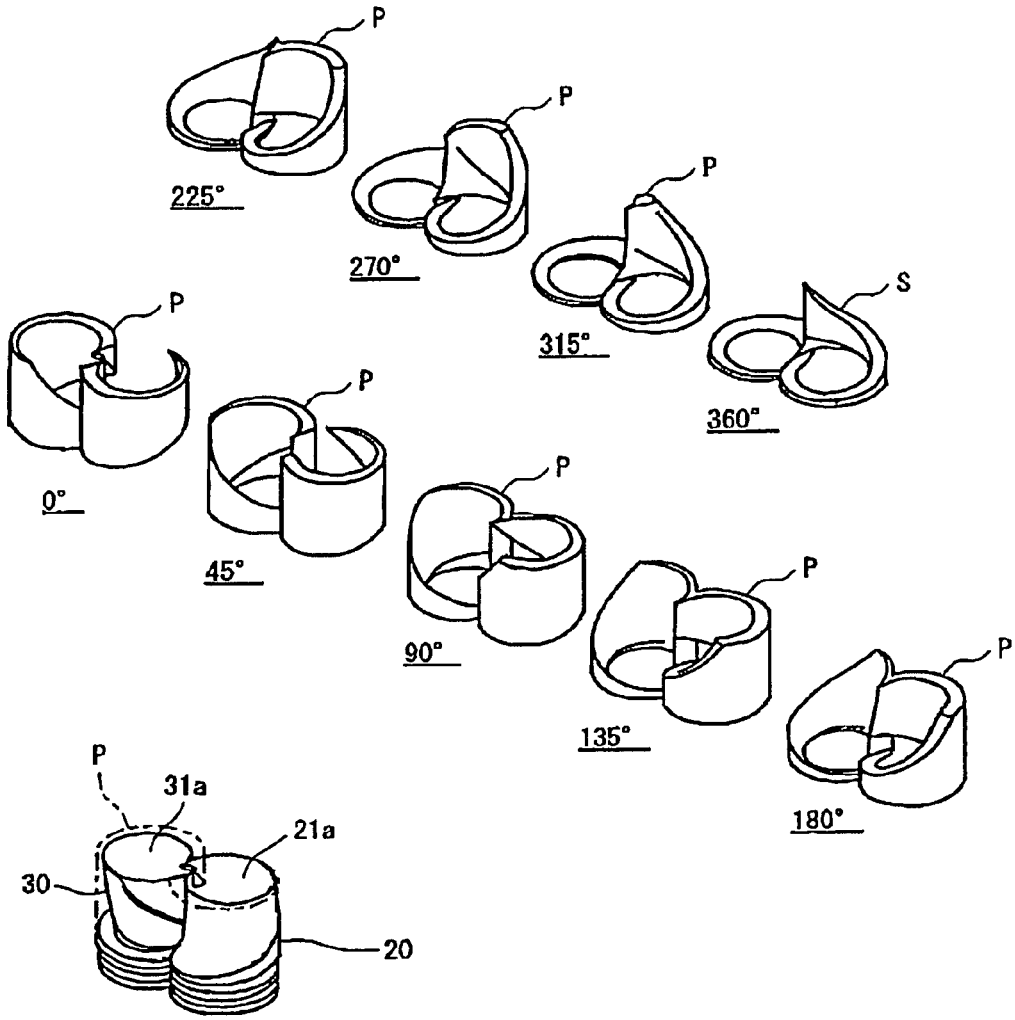
FIG. 5 is a perspective view showing an inlet space which changes its volume during one turn of the rotors.
Figure 6:
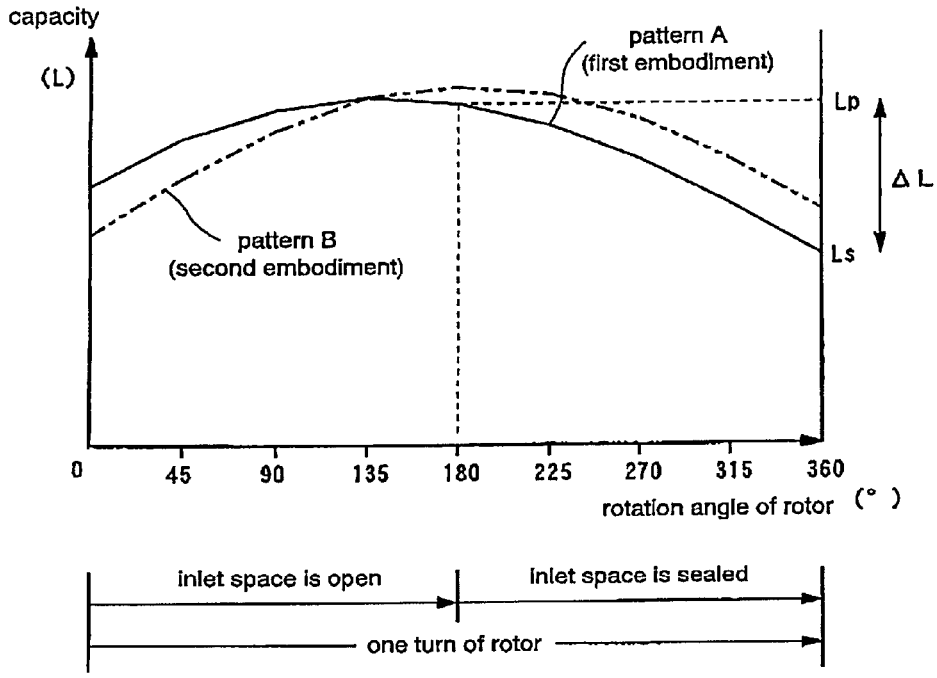
FIG. 6 is a graph showing the change of the volume of the inlet space during one turn of the rotors.

When the communication between the inlet space P and the inlet port 17 is just blocked thereby to form the pump space S, the position of the rotors 20, 30 will be referred to as a starting position of one turn of the rotors 20, 30, or, as rotation angle 0° of the rotors 20, 30. The inlet space P changes its volume in accordance with the rotation of the rotors 20, 30, as shown in FIGS. 5 and 6. FIG. 4 is a plan view of the intermeshing rotors 20, 30 as seen from the inlet port 17, showing changes of intermeshing relation of the rotors 20, 30 from the starting position of one turn (rotation angle 0°) until the rotors 20, 30 complete one turn (rotation angle 360°). The inlet space P changes its volume and its volume becomes the maximum during one complete turn of the rotors 20, 30, that is, in the range from the starting position to less than one complete turn as shown in FIG. 5. FIG. 6 is a graph showing the relationship between the rotation angle of the rotors 20, 30 (on the horizontal axis) and the volume of the inlet space P (on the vertical axis). The rotation angle of the rotors 20, 30 where the volume of the inlet space P becomes maximum depends on maximum lead angle of the first portions 25, 35, the number of turns of helix, radial and axial dimensions of the first portions 25, 35.

As mentioned above, a plurality of closed pump spaces 8 are formed on the side adjacent to the inlet space P, as shown in FIG. 1. The pump space S located nearest to the inlet space P is a space into which the fluid in the inlet space P is transferred after the rotors 20, 30 have made one complete turn from the starting position. In the present embodiment, the volume of the pump space S is set smaller than the maximum volume of the inlet space P. The closed pump spaces S are formed successively and moved toward the outlet end of the rotors 20, 30 while compressing fluid therein in accordance with the rotation of the rotors 20, 30. The volume of the pump spaces S which are formed by the first portions 25, 35 of the rotors 20, 30 changes in accordance with the changing lead angle. On the other hand, the volume of the pump spaces S which are formed by the second portions 26, 36 of the rotors 20, 30 remains unchanged due to a constant lead angle of the helical threads in the second portions 26, 36. Each closed pump space S corresponds to the working chamber.

The cover plate 40 will now be described. The rotors 20, 30 have the same axial dimension and their end faces 21*a*, 31*a* are located in the same plane. The cover plate 40 is fixed to the inner wall of the rotor housing 14 so as to partially cover the end faces 21*a*, 31*a* of the rotors 20, 30. Although not shown in FIG. 1, any known fixing means such as a bolt may be used for fixing the cover plate 40 to the rotor housing 14. As shown in FIG. 2, the cover plate 40 of the present embodiment is adapted to cover about a half of the end face 21*a* and about a quarter of the end face 31*a*. An engaging point between the rotors 20, 30 is designated by reference character G. A circular arrow indicates the rotating direction, and the cover plate 40 is arranged so as to cover part of the end faces 21*a*, 31*a* in the region which is coming to reach the engaging point G, as shown in FIG. 2. In other word, the cover plate 40 covers a part of the inlet openings 27, 37 and the closed inlet space P is defined by the rotors 20, 30, the rotor housing 14 and the cover plate 40. The closed inlet space P contributes to increase the volume of fluid to be transferred by the rotors 20, 30 and, therefore, the efficiency of drawing the fluid into the screw pump 11 is improved.

In the present embodiment, the end faces 21*a*, 31*a* of the rotors 20, 30 are, spaced from the lower end face of the upper housing 16 at a predetermined distance so that an inlet chamber 18 is formed in the rotor housing 14 in facing relation to the end faces 21*a*, 31*a* of the rotors 20, 30.

The following will now describe the operation of the above-described embodiment of the screw pump 11. The inlet space P of the screw pump 11 of the present preferred embodiment changes its volume during one complete turn of the rotors 20, 30 from the starting position, as indicated by the pattern A curve in FIG. 6. Where the rotation angle of the rotors 20, 30 ranges between 0° and 180°, exclusive of 180°, the inlet space P is in communication with the inlet chamber 18 through the inlet openings 27, 37 of the rotors 20, 30, thus allowing the fluid in the inlet chamber 18 to be drawn into the inlet space P through the inlet openings 27, 37. FIG. 4 shows such communication state in the case of the rotation angles of 0°, 45°, 90° and 135°. As shown by the pattern A curve in FIG. 6, the inlet space P has the maximum volume when the rotation angle is about 135°.

When the rotors 20, 30 are rotated to 180° position, a part of the inlet openings 27, 37 is separated from the inlet chamber 18 by the cover plate 40. For the sake of explanatory convenience, such part of the inlet openings 27, 37 separated from the inlet chamber 18 will be referred to as closure regions 27*a*, 37*a* (see a dark shaded region of FIG. 4). When the closure regions 27*a*, 37*a* are formed in the inlet openings 27, 37, the cover plate 40, the rotors 20, 30 and the rotor housing 14 define the closed inlet space P which does not communicate with the inlet chamber 18 through the inlet openings 27, 37. During further rotation of the rotors 20, 30, at least one of the closure regions 27*a*, 37*a* of the inlet openings 27, 37 remains to exist while reducing its area until the rotation angle reaches 360°. When the rotation angle 360° is reached, the inlet space P is transferred to a pump space S. At the same time, a new inlet space P is formed at the inlet end of the rotors 20, 30.

In the present embodiment, there exists a closed inlet space P at the rotation angle of 180°. Compared to the conventional case where the inlet space P is constantly in communication with the inlet chamber 18 (or the inlet port 17) until the inlet space P is transferred to the pump space S, the volume of fluid enclosed in the pump space S is increased in the present embodiment. Referring to the graph in FIG. 6, the increase of the volume of the fluid is designated by ΔL. The increase of fluid volume ΔL corresponds to the difference between the volume Lp of the inlet space P and the volume Ls of the pump space S. That is, when the inlet space P is constantly in communication with the inlet chamber 18 (or the inlet port 17) until the inlet space P is transferred to the pump space S, the volume of fluid enclosed in the pump space S corresponds to the volume Ls. When the inlet space P is closed at the rotation angle 180°, on the other hand, the volume of fluid enclosed in the closed inlet space P corresponds to the volume Lp. The change of volume of the inlet space P is shown in FIG. 5. The inlet space P is transferred to a pump space S after the rotors 20, 30 have made a complete turn of 360°.

After the complete turn of the rotors 20, 30, a next inlet space P is formed at the inlet end of the rotors 20, 30. As described above, during the rotation of the rotors 20, 30, fluid in the pump space S is transferred to a pump space S. By rotating the rotors 20, 30 further continuously, fluid in the pump spaces S is transferred toward the outlet port 15 successively through the first portions 25, 35 and the second portions 26, 36 and finally discharged out from the outlet port 15. The second portions 26, 36 of the rotors 20, 30 prevent the fluid from flowing reversely toward the first portions 25, 35.

The screw pump of the first embodiment has the following advantageous effects.

(1) According to the preferred embodiment of screw pump, the cover plate 40 covers part of the inlet openings 27, 37 thereby to close the inlet space P hermetically when the volume of the inlet space P just exceeds that of the pump space S. The volume of fluid to be transferred is increased by the differential ΔL between the volume Lp of the closed inlet space P and the volume Ls of the pump space S. Therefore, the efficiency for drawing fluid into the screw pump 11 is improved and the performance of the screw pump 11 is improved, accordingly.

(2) Since the volume of fluid to be transferred is increased by the differential ΔL between the volume Lp of the closed inlet space P and the volume Ls of the pump space S, axial length of the rotors 20, 30 is reduced, thus allowing the size and weight of the screw pump 11 to be reduced.

(3) Since the cover plate 40 closes the inlet space P at ½ turn of the rotors 20, 30, the time to draw the fluid into the inlet space P through the inlet port 17 is ensured at least in the range from the state where the inlet space P starts to be formed (or the position of the rotation angle 0°) to ½ turn position of the rotors 20, 30.

(4) The inlet space P is closed before the rotors 20, 30 make one complete turn from the state where the inlet space P just starts to be formed. Accordingly, the first portions 25, 35 of the rotors 20, 30 are effectively used thereby to improve the working performance of the screw pump 11.

(5) Compared with a case where the cover plate is integral with the housing of the screw pump, replacement of the cover plate 40 and relocation thereof relative to the rotors 20, 30 may be performed easily in accordance with conditions, to drive the screw pump, such as the type of rotors 20, 30 for use.

(6) Providing the second portions 26, 36 of the rotors 20, 30 adjacently to the inlet end of the rotors 20, 30, the pump space S in the second portions 26, 36 prevents the fluid which is transferred from the first portions 25, 35 to the second portions 26, 36 from flowing reversely.

Figure 7:
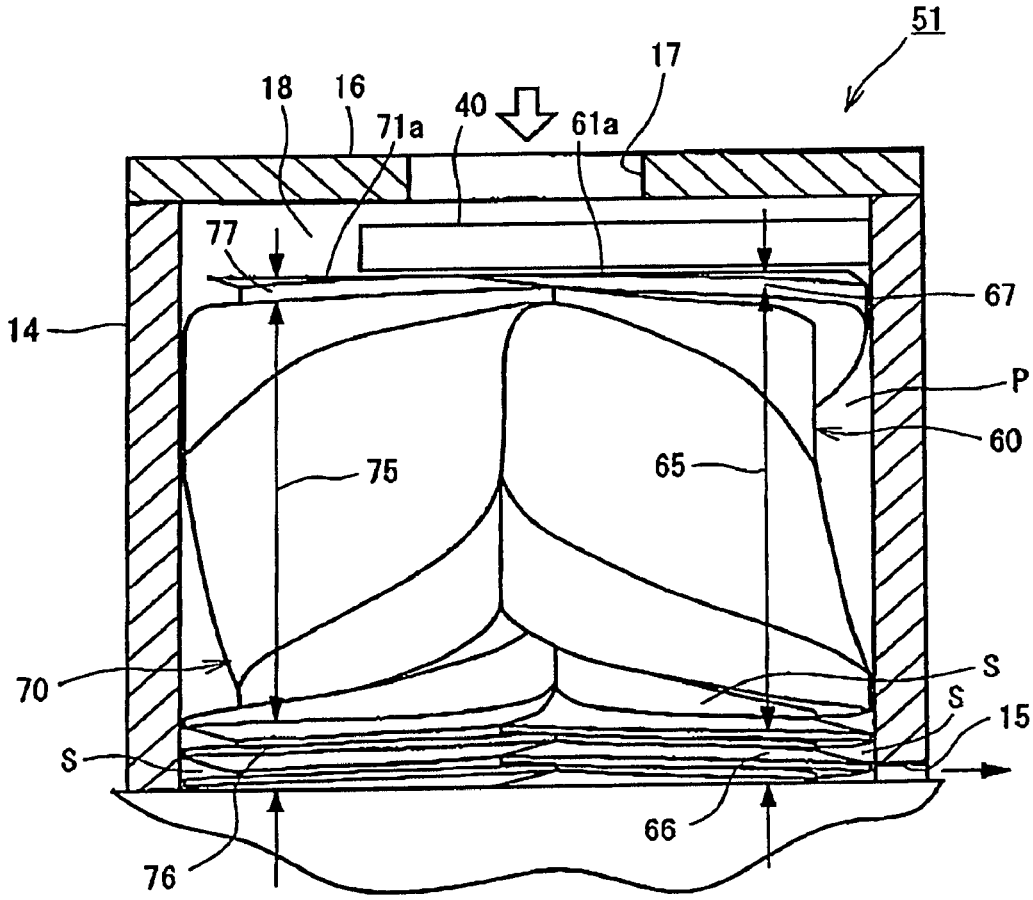
FIG. 7 is a front view showing a pair of intermeshing rotors of a screw pump according to a second embodiment of the present invention.

The following will describe a screw pump according to a second embodiment of the present invention with reference to FIGS. 6 and 7. The screw pump of the present embodiment is substantially the same as that of the first embodiment except that the structure of the rotors differs from that of the first embodiment. Therefore, description of common elements or parts of the screw pump will be omitted and the reference symbols used for description of the first embodiment will be used to denote the common elements.

Referring to FIG. 7, the screw pump 51 of the present embodiment includes a drive rotor 60 and a driven rotor 70. The rotors 60, 70 include first portions 65, 75, second portions 66, 76 and third portions 67, 77 which are located extending from the first portions 65, 75 toward the inlet port 17. The third portions 67, 77 are formed in the region from the end faces 61*a*, 71*a* to a position between the point corresponding to ½ turn of the rotors 60, 70 and the point before the full turn of the rotors 60, 70. The third portions 67, 77 are formed with a lead angle that is smaller than that of the first portions 65, 75. In the present embodiment, the lead angle of the third portions 67, 77 is the same as that of the second portions 66, 76.

The third portions 67, 77 whose lead angle is smaller than that of the first portions 65, 75 are provided at the inlet end of the rotors 60, 70. Therefore, the time when the inlet space P becomes maximum in volume can be set in a range from the starting position of one turn of the rotors 60, 70 to the position where the rotors 60, 70 complete their one turn, exclusive of both positions (or in a range from a position of the rotors 60, 70 where their rotation angle is larger than 0° to a position thereof where their rotation angle is smaller than 360°). In the present embodiment, the third portions 67, 77 of the rotors 60, 70 are formed so that the volume of the inlet space P becomes maximum at the position where the rotors 60, 70 have made a ½ turn (or at the position corresponding to the rotation angle of 180°) from the starting position of one complete turn of the rotors 60, 70. The first portions 65, 75 and the second portions 66, 76 are substantially the same as those of the first embodiment. In addition, the maximum lead angle of the first portions 65, 75 and the lead angle of the second portions 66, 76 are substantially the same as those of the first embodiment. The cover plate 40 is provided to cover about a half of the end face 61 a of the drive rotor 60, about a quarter of the end face 71*a* of the driven rotor 70 and a part of inlet opening (not shown) provided on the end faces 61*a*, 71*a*.

According to the present embodiment, the inlet space P has the maximum volume at the position of the rotors 60, 70 where they have made a ½ turn from the starting position. In this position, a closure region (not shown) of the inlet opening is formed by the cover plate 40, so that the cover plate 40, the rotors 60, 70 and the rotor housing 14 define a closed inlet space P. As shown by pattern B curve in FIG. 6, the inlet space P of the present embodiment changes its volume.

The screw pump of the second embodiment has substantially the same effects as those (1)-(6) of the first embodiment. In addition, the present second embodiment in which the cover plate 40 closes the inlet space P when the volume of the inlet space P becomes the maximum utilizes the inlet space P most effectively. Furthermore, since the third portions 67, 77 are provided at the inlet end of the rotors 60, 70, the time when the inlet space P has the maximum volume can be set in a range between the starting position of one turn of the rotors 60, 70 and the position where the rotors 60, 70 complete their one turn, exclusive of both positions (or in a range from the rotation angle of 0° to the rotation angle of 360°, exclusive of 0° and 360°). Therefore, it is easy ensure the time to draw fluid into the inlet space P during one turn of the rotors 60, 70. In addition, the inlet space P may be closed by the cover plate 40 at an appropriate time in accordance with the driving condition of the screw pump 51.

The present invention is not limited to the above first and second embodiments, but may be practiced in various ways within the scope of the invention.

In the above first and second embodiments, the cover plate forms the closure region in the inlet opening when the rotors 60, 70 have made a ½ turn (or when the rotors 60, 70 are at the position of 180° rotation angle) from the starting position. However, the time of forming the closure region in the inlet opening is not limited to ½ turn, but may be set in a range between at least ⅛ turn position and one complete turn position, exclusive of the latter position. In this case, at least duration of time corresponding to ⅛ turn of the rotors is available for drawing fluid into the inlet space.

Figure 8:
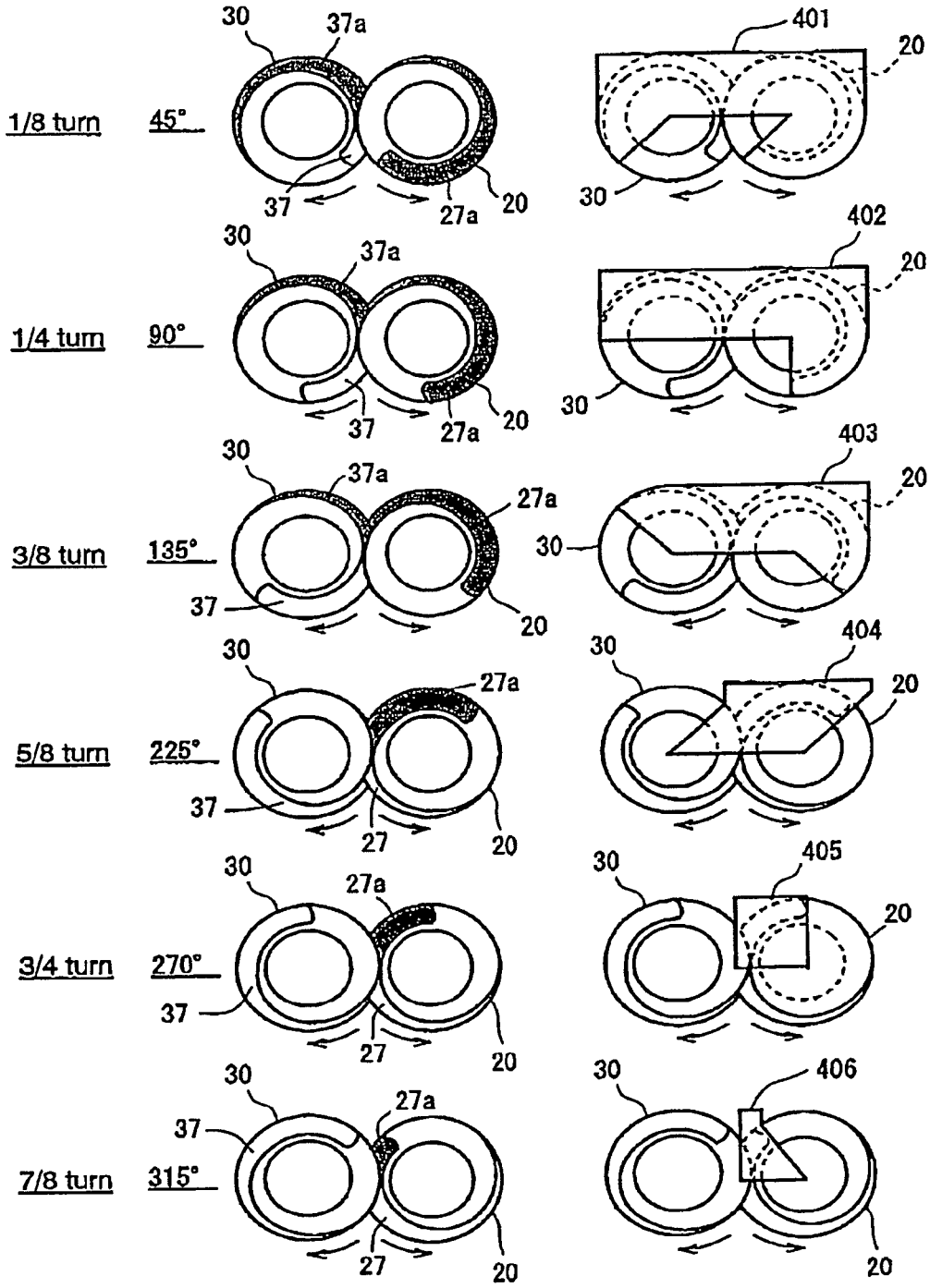
FIG. 8 is a plan view showing closure regions of the inlet openings at different turned positions of the rotors and the closure members for accomplishing the closure regions of the inlet openings.
Figure 9:
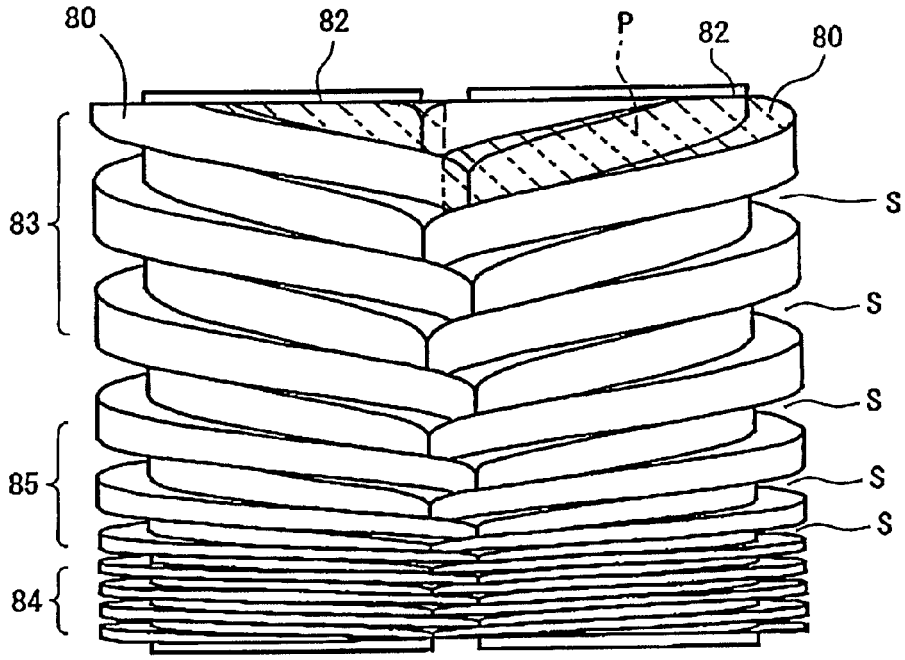
FIG. 9(BACKGROUND ART)
FIG. 9 is a front view showing a pair of intermeshing rotors of a conventional screw pump.

In the above first and second embodiments, the cover plate is disclosed as the closure member for forming the closure region in the inlet opening at the time of ½ turn. However, the shape of the cover plate may be changed in accordance with the desired time at which the inlet openings 27, 37 should be closed, as exemplified in FIG. 8. FIG. 8 shows the closure regions 27*a*, 37*a* (indicated by dark shaded regions) of the inlet openings 27, 37 at the positions of the rotors 20, 30 at ⅛, ¼, ⅜, ⅝, ¾, ⅞ turns, respectively, and the corresponding cover plates 401-406 each serving as a closure member for achieving the closure regions 27*a*, 37*a* of the inlet openings 27, 37. The shape of the cover plate is not limited to those of the cover plates 401-406, but any shape may be used as long as the cover plate achieves the desired closure regions of the inlet openings 27, 37 for the respective angular positions.

Although in the above first and second embodiments the inlet chamber is provided in the housing, the rotor housing may have the function of the cover plate (closure member) without providing an inlet chamber in the housing. In this case, the cover plate helps to reduce the number of parts of the screw pump.

In the above first and second embodiments lead angle of the first portions of the rotors decreases from the inlet end thereof toward the opposite outlet end However, the lead angle of the first portions need not necessarily decrease, but it may increase or combination of increasing and decreasing leads may be used.

Although in the above first and second embodiments the screw pump is of a vertical type wherein the axes of rotors thereof are vertically arranged, the present invention is also applicable to screw pumps having the axes of the rotors thereof disposed otherwise.

Although the screw pump in the above first and second embodiments has a screw rotor with a single-start thread, the number of threads is not limited For example, a screw rotor with a double-start thread may be employed. In addition, the number of helical threads and thread grooves of the rotors may be determined appropriately.

It is noted that a screw pump having rotors whose inlet space becomes maximum in volume only after the rotors have made one complete turn from the starting position thereof, (the maximum volume of the inlet space not exceeding the volume of a pump space,) will be excluded from the scope of the present invention. This is because the volume of fluid to be transferred in the screw pump will not be increased as long as the volume of fluid in the inlet space does not exceed the volume of fluid in the pump space, no matter where the inlet space is sealed. That is, if the inlet space is closed by the cover plate (or closure member) in a screw pump in which the volume of fluid in the inlet space P does not exceed that in the pump space S, the volume of fluid to be transferred is decreased, with the result that the working efficiency of the screw pump will be reduced. Therefore, the present invention is applicable to a screw pump wherein the fluid volume of the inlet space exceeds that of the pump space.

Therefore, the present examples and embodiments are to be considered as illustrative and not restrictive, and the invention is not to be limited to the details given herein but may be modified within the scope of the appended claims.

What is claimed is:

1. A screw pump comprising:

an upper housing having an inlet port for allowing fluid to be drawn therethrough into a rotor housing, wherein an outlet port is formed in the rotor housing for allowing the fluid to be delivered through the outlet port out of the rotor housing; and a pair of screw rotors rotatably disposed in the rotor housing in engagement with each other, an end face of the rotor adjacent to the inlet port being provided with an inlet opening, each rotor having a first portion whose lead angle changes, wherein the first portions and the rotor housing cooperate to form an inlet space which is in communication with the inlet port through the inlet openings for allowing the fluid to be drawn into the inlet space and whose volume is variable in accordance with the rotation of the rotors, wherein during the rotation of the rotors, the communication between the inlet space and the inlet port is blocked by the first portions and the rotor housing thereby to form a closed pump space adjacent to the inlet space, wherein when the communication between the inlet space and the inlet port is blocked to form the closed pump space, a position of the rotors is defined as a starting position of one turn of the rotors, wherein the inlet space changes its volume thereof and the volume of the inlet space becomes the maximum in the range from the starting position to less than one turn of the rotors, wherein volume of the closed pump space is set smaller than the maximum volume of the inlet space by setting the lead angle of the first portions, wherein a closure member is provided which covers at least a part of the inlet openings, and wherein the closure member closes the inlet space when the volume of the inlet space exceeds the volume of the closed pump space.

2. The screw pump according to claim 1, wherein the closure member has such a shape as to close the inlet space in a range between a position corresponding to ⅛ turn of the rotors from the starting position and a position corresponding to one turn of the rotors from the starting position, exclusive of the position of the one turn.

3. The screw pump according to claim 1, wherein the closure member has such a shape as to close the inlet space at a position corresponding to approximately ½ turn of the rotors from the starting position.

4. The screw pump according to claim 1, wherein the closure member has such a shape as to close the inlet space when the volume of the inlet space becomes the maximum.

5. The screw pump according to claim 1, wherein the closure member is separate from the rotor housing and is removably mounted on the rotor housing.

6. The screw pump according to claim 1, wherein each rotor has a second portion which is formed continuously from the first portion toward an outlet port, and wherein lead angle of the second portion is constant and set smaller than that of the first portion.

7. The screw pump according to claim 1, wherein each rotor has a third portion which is located from the first portion toward the inlet port, the third portion being formed in a region from the end face of the rotor to a position between a point corresponding to ½ turn of the rotors from the starting position and a point before the one turn of the rotors from the starting position, lead angle of the third portion being set smaller than that of the first portion.

8. The screw pump according to claim 1, wherein the lead angle of the first portion decreases progressively from the end on the rotor adjacent to the inlet port toward the outlet port.

9. The screw pump according to claim 1, wherein the closure member is a cover plate.

10. The screw pump according to claim 1, wherein each rotor is of a single-start thread.

* * * * *

UNITED STATES PATENT AND TRADEMARK OFFICE

CERTIFICATE OF CORRECTION

PATENT NO. : 7,497,672 B2
APPLICATION NO. : 11/891531
DATED : March 3, 2009
INVENTOR(S) : Masahiro Inagaki et al.

It is certified that error appears in the above-identified patent and that said Letters Patent is hereby corrected as shown below:

Column 4, line 66, please delete "pump spaces 8" and insert therefore
-- pump spaces S --;

Signed and Sealed this

First Day of September, 2009

David J. Kappos

David J. Kappos
*Director of the United States Patent and Trademark Office*